United States Patent [19]

Blowers

[11] Patent Number: 5,067,761

[45] Date of Patent: Nov. 26, 1991

[54] MASONRY HAWK

[76] Inventor: James I. Blowers, 10016 Washington Rd., Glen Allen, Va. 23060

[21] Appl. No.: 561,186

[22] Filed: Aug. 1, 1990

[51] Int. Cl.[5] ..... E04G 21/02

[52] U.S. Cl. ..... 294/3.5; 294/172

[58] Field of Search ..... 294/3.5, 144, 146, 172; 15/235.4, 235.5, 235.6, 235.7, 235.8; D7/550, 551; D8/45, 71

[56] References Cited

U.S. PATENT DOCUMENTS

| | | | |
|---|---|---|---|
| 219,183 | 9/1879 | Tait | 294/172 X |
| 2,821,078 | 1/1958 | Steward | 294/3.5 X |
| 3,315,858 | 4/1967 | Horner | 294/172 X |

FOREIGN PATENT DOCUMENTS

| | | | |
|---|---|---|---|
| 248226 | 3/1926 | United Kingdom | 294/172 |
| 855622 | 12/1960 | United Kingdom | 294/3.5 |
| 996187 | 6/1965 | United Kingdom | 294/3.5 |

*Primary Examiner*—Russell D. Stormer
*Assistant Examiner*—Dean J. Kramer
*Attorney, Agent, or Firm*—Nies, Kurz, Bergert & Tamburro

[57] ABSTRACT

A hawk or mortarboard device to be carried with one arm while working, designed to be supported in two areas, i.e., forward by the hand, and rearward by the forearm and/or upper arm, thereby making the device easier to carry and handle with less carrying fatigue.

3 Claims, 1 Drawing Sheet

FIG. 1
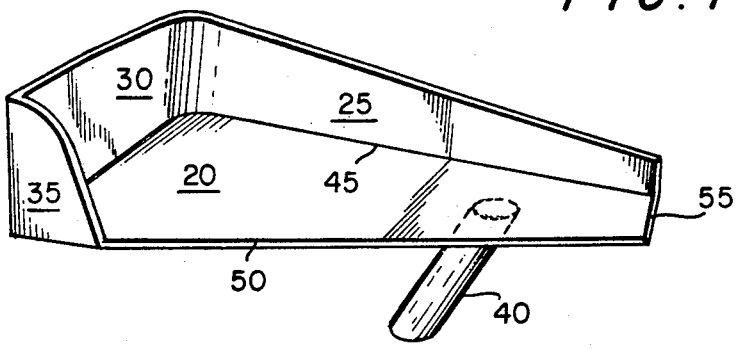
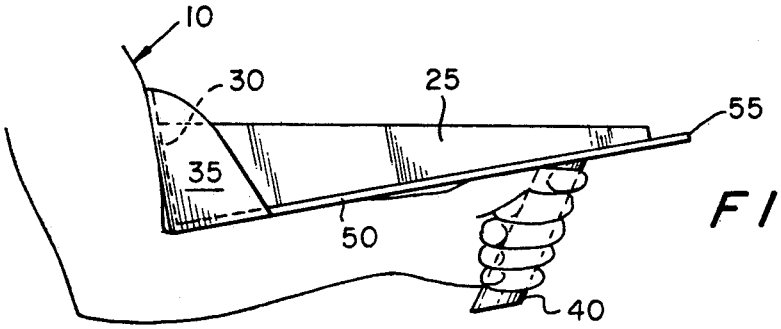
FIG. 2
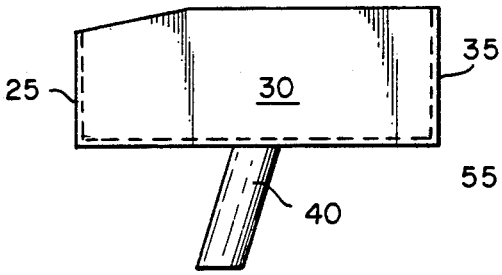
FIG. 3
FIG. 4
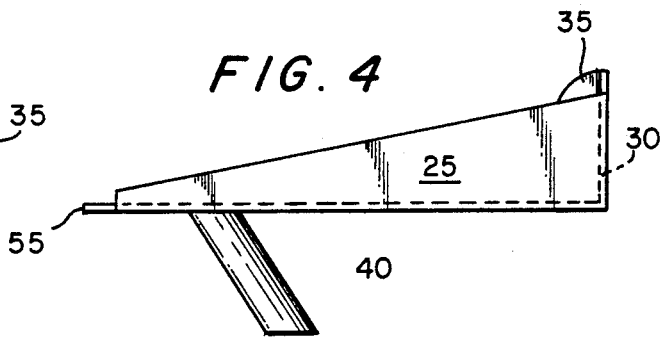
FIG. 5
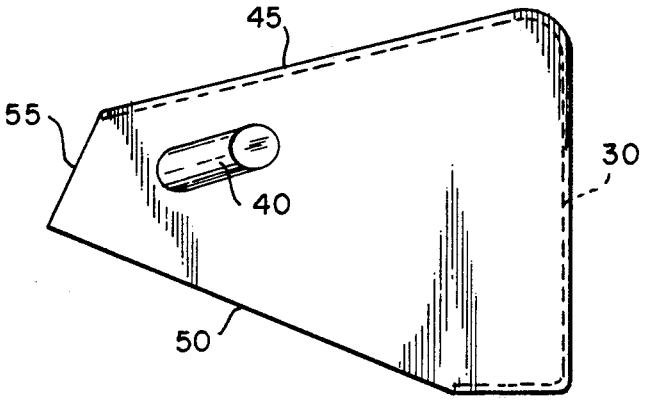

MASONRY HAWK

The present invention relates to a hawk device for holding materials in various fluidic states most commonly used in construction such as mortar, cement, plaster, and the like, well known in the art and generally referred to herein as mortar or mortar-like materials.

Previously known hawk devices, also known as mortarboards, generally include a square platen on which mortar is placed and held by means of a handle extending down from the bottom center of the platen or down from the center of the load created by the mortar in the hawk.

Due to the structure of such previous devices, relatively small mortar loads are carried, and in any event, during the course of a work day, have the problem of causing fatigue of the carrying arm, thereby creating a condition for inefficient or sloppy work. There have been suggestions to improve working support of a hawk, e.g., the provision of means to hold it against a wall while troweling material therefrom onto the wall, or to incorporate means in the device to make the holding hand more comfortable such as a rubberized gasket located between the platen and handle. These suggestions do not successfully treat the problem, however.

The principal object of the present invention is to provide a novel hawk which will reduce strain on the worker's carrying arm and hand supporting the loaded hawk, yet which permits ease of movement while working. In addition, in case of emergency or need to perform other tasks, the invention, in its preferred form, also allows the loaded hawk to be placed on the ground or other resting place without spilling. More specifically, it is an object of the present invention to provide a hawk which can be supported in a unique manner by the worker, utilizing hand and arm areas to contact the hawk to distribute the load, and by the same means, facilitate movement and increased load carrying capability, especially for longer periods such as a work day.

These objects are accomplished, briefly, in connection with a hawk having a mortar-carrying platen on top of which mortar-like materials are to be carried by a worker by means of a downwardly extending handle. The platen is provided with side walls and the handle is positioned forward of the platen mid-point away from the worker and mortar load thereby shifting the center of the loaded hawk's weight back from the worker's hand toward the worker's body in such a manner that the worker's forearm or upper arm is caused to accept some of the weight and distribute it more evenly, as in support of a beam at two points, rather than by a single support concentrated at the hawk handle conventionally located at the loaded center of gravity.

Other objects will become apparent and will be specifically pointed out in the following description of the preferred embodiment of the invention as depicted in the drawing.

DRAWING

FIG. 1: A perspective view of the novel hawk device disclosed herein.

FIG. 2: A right side elevation view of the device shown in FIG. 1 with the rear edge shown cradled in a worker's arm at the elbow and held with one hand.

FIG. 3: A rear elevation view showing the rear wall which faces a worker while using the hawk of this invention.

FIG. 4: A left side elevation view.

FIG. 5: A bottom view.

For convenience, the description of the hawk shown in the drawing is made as if the worker is right handed and would therefore hold the hawk with his left hand and arm, it being understood that the left hand description would be equivalent. The rear of the device is described nearest the worker and the front of the device nearest the work face or wall on which mortar is to be applied. As shown in FIGS. 1 and 2, the worker indicated generally as 10 in FIG. 2 holds the hawk device cradled in his left arm.

In the preferred embodiment a platen 20 is shown with a left side wall 25, rear wall 30 and right side wall 35. A handle 40 is provided on the bottom forward portion of the platen angled to the rear and joined by bolting or other conventional means.

The hawk may be constructed of any conventional materials consistent with the mortar or other material to be carried or worked with, wood, non-oxidizing metal and plastic having been used in the art, for example.

Platen 20 is shown as a flat surface, which is preferable, however a reservoir may be created if desired toward the rear by depth forming curvature therein. As mentioned above, one of the principal objectives of the present hawk invention is to influence the center of the load or mortar toward the worker's body between the handle 40 and the rear wall 30 to achieve support and allow mobility not heretofore achieved in the art. For this purpose platen 20 is preferably longer than it is wide and has side edges 45 and 50 which taper toward each other from rear to front, promoting the desired loading effect by providing relatively less load space from front to rear.

Side walls 25-30-35 provide a retainer for the semi-fluid load on platen 20. Wall 25 is gradually reduced in height from rear to front to promote distribution of the fluidized load gradually toward the rear. Wall 35 is not essential but adds to the capacity of the hawk and helps the worker climb or walk to the work site without spilling from the loaded platen surface.

Handle means 40 is preferably tilted toward the rear and to the left as shown in FIGS. 2–6 so that the acute angle between the handle and platen bottom is from 20–70 degrees, preferably 45 degrees. This is important in that the worker will naturally hold the device by the angled handle at the front and with the forearm angled slightly up from the horizontal as shown in FIG. 2. The device is thereby held more comfortably situated and over longer periods of time with less fatigue because the angled handle permits a normal hand-forearm handshake extension relationship to remain substantially unchanged, i.e., without the need for wrist cocking or vertical hand movement, yet resulting in the desired positioning of the device to achieve combined front and rear support by resting the rear portion of platen 20 on the forearm or the rear wall 30 against the upper left arm, or both. The result is a rearward cradling support to complement the forward hand support. Walls 25 and 30 are shown extending completely across the back and along the longitudinal length of platen 20; however, although they need to be joined at the left rear, it is possible for them to extend only partially over such lengths. The walls 25, 30 and 35 are preferably joined together in a rounded intersection. As mortar is removed when cleaning the device, rounded corners enable the trowel or cleaning tool to work more smoothly.

The location of handle 40 in relationship to the platen is important to the invention. In the preferred form of the invention, shown especially in FIGS. 1 and 6, handle 40 is positioned to extend downwardly from the front half section of the platen, preferably about one-quarter of the platen length from the front edge. The exact location of the handle may vary depending on design variations of the overall device however, and although is preferably positioned along the longitudinal axis of the platen, such is not essential. The platen is preferably 14–15 inches long with the rear and front edges being 10–13 inches and 3–6 inches long, respectively, but in one variation side 50 may be much longer than side 45 by several inches and the sides being connected together by back wall 30 forming an obtuse inner angle at its intersection with wall 25, in a design allowing for greater loads and promoting even greater rear support by extending side 50 rearwardly toward the worker's body.

In operation, the worker will hold the device by the handle tilted back as described, which makes it easier to grip and enables the worker to carry it at a slightly upward incline from rear to front. As already mentioned, the rear portion of the hawk resting on the forearm or against the worker's upper arm, or in both positions, makes the hawk feel lighter and permits longer use. Of course, not all forearms are the same length, so the total effect may vary slightly from one worker to the other, but the primary purpose of the invention will be achieved by either or both rearward forearm or upper arm contact and support.

The handle also being tilted toward the left not only helps bias the load in the desired direction as mentioned above, it also makes the platen rest on the flat portion of the hand between the thumb and forefinger, rather than on the knuckle of the thumb. The degree of left tilting of the hand is not critical but should be between 5 and 35 degrees, preferably about 10 degrees.

The present hawk may be placed on the ground or other surface without spilling its load of mortar by resting the handle 40 and the bottom rear edge of wall 30 thereon. Wall 35 will normally help retain the mortar when this is done. The ability to rest the hawk without spilling is a very attractive practical feature to the artisan.

Other advantages and variations or equivalents of the invention herein described will become apparent to those skilled in the art and are considered within the scope of the claims set forth below. The above description and drawing is therefore not intended to be all inclusive, but rather a description of the best mode of carrying out the invention.

Having described my invention, I claim:

1. A masonry hawk device for holding a supply of mortar or the like comprising a platen on top of which mortar is to be held with handle means extending down from the bottom side thereof for holding the device with one hand while working with an applicator such as a trowel in the other; said platen having front and rear edges and right and left side edges, said rear edge and one of said side edges being substantially bounded by upwardly extending walls, said walls intersecting and being joined at a rear corner of the platen to form an unbroken retaining wall along said rear edge and one side edge, a short upwardly extending side wall extending from said rear wall along a minor portion only of the other side edge, a major portion of said other side edge being unbounded, and said front edge being unbounded, said handle means being positioned on said platen forward of the midpoint thereof whereby the loaded hawk may be simultaneously supported by the worker's hand holding the handle and the worker's arm contacting the rear portion of the device.

2. A masonry hawk device as defined in claim 1, wherein said handle means extends down and toward the rear edge of said platen.

3. A masonry hawk device as defined in claim 1, wherein said handle means is tilted toward the rear edge of said platen and toward one side thereof.

* * * * *